US009365984B2

(12) United States Patent
Flaherty et al.

(10) Patent No.: US 9,365,984 B2
(45) Date of Patent: Jun. 14, 2016

(54) UNIVERSAL RADIUS TACTILE WARNING SURFACE PRODUCT

(75) Inventors: John P. Flaherty, Woburn, MA (US); William Scott Ober, Hopkinton, MA (US)

(73) Assignee: ADA Solutions, Inc., Chelmsford, MA (US)

( * ) Notice: Subject to any disclaimer, the term of this patent is extended or adjusted under 35 U.S.C. 154(b) by 807 days.

(21) Appl. No.: 12/873,627

(22) Filed: Sep. 1, 2010

(65) Prior Publication Data

US 2011/0185961 A1 Aug. 4, 2011

Related U.S. Application Data

(60) Provisional application No. 61/300,282, filed on Feb. 1, 2010.

(51) Int. Cl.
*E04F 15/00* (2006.01)
*E01C 5/00* (2006.01)

(52) U.S. Cl.
CPC ..... *E01C 5/00* (2013.01)

(58) Field of Classification Search
CPC ..... E04F 15/10; E04F 15/102; E04F 15/02; E04F 15/02044; E01F 9/06; E01F 9/047; E01F 9/083; E01C 5/00; E01C 5/20
USPC ..... 52/33, 174–177, 179, 180, 181, 514, 52/514.5, 746.1, 747.1, 747.11; 404/12–16, 19, 34–43, 73, 75; 116/205
See application file for complete search history.

(56) References Cited

U.S. PATENT DOCUMENTS

| | | | | |
|---|---|---|---|---|
| 5,217,319 | A | 6/1993 | Klohn | |
| 5,385,770 | A | 1/1995 | Julnes | |
| 6,760,978 | B2 * | 7/2004 | Gleeson | 33/563 |
| 6,971,818 | B1 | 12/2005 | Schabacker | |
| 7,001,103 | B2 | 2/2006 | Sippola | |
| 7,779,581 | B2 | 8/2010 | Flaherty et al. | |
| 2007/0092335 | A1 * | 4/2007 | Wehmeyer | 404/19 |
| 2007/0201949 | A1 | 8/2007 | Veldboom et al. | |
| 2008/0197328 | A1 * | 8/2008 | Young | 254/14 |
| 2008/0280097 | A1 | 11/2008 | Flaherty et al. | |

OTHER PUBLICATIONS

Access Tile Engineering Drawing (Cast-In-Place Curve) Date: Oct. 9, 2008.

(Continued)

*Primary Examiner* — William Gilbert
(74) *Attorney, Agent, or Firm* — Nields, Lemack & Frame, LLC

(57) ABSTRACT

An apparatus and method for using a single radial TWS product for a variety of applications is disclosed. Radial TWS products are used for intersections and the like. Often, different applications require radial TWS products of varying dimensions. The present invention includes a radial TWS product, having domes on its upper surface, which are ADAAG compliant. Markings are placed on the bottom surface, which indicate the appropriate places where the TWS product can be cut to achieve a variety of effective radii. These markings are positioned such that, after being cut, the resulting radial TWS product continues to meet the ADAAG required center-to-center spacing between domes of adjacent cut TWS products. In some embodiments, anchor members are used in conjunction with the TWS product to allow simple replacement.

22 Claims, 14 Drawing Sheets

(56) References Cited

OTHER PUBLICATIONS

Armor-Tile Installation Guide (Surface-Applied-Radius Installation) date: Apr. 3, 2007.
Detectable Warning Systems Instruction Guide (DWS.TWS.EZ-Set. Kit.Spec.Dwg.Install1) date: Mar. 11, 2004.
East Jordan Iron Works Brochure (DURALAST_Brochure) Date: Jan. 1, 2010.

International Search Report and Written Opinion dated Mar. 25, 2011 in corresponding application PCT/US2011/022718.

* cited by examiner

UNIVERSAL RADIUS TACTILE WARNING SURFACE PRODUCT

This application claims priority of U.S. Provisional Patent Application Ser. No. 61/300,282, filed on Feb. 1, 2010, the entire disclosure of which is incorporated herein by reference.

BACKGROUND OF THE INVENTION

Tactile Warning Surface (TWS) products are required in certain locations under the Americans with Disabilities Act Accessibility Guidelines (ADAAG). The ADAAG defines certain types of applications, including curb ramps/pedestrian crossings, commercial applications (e.g., retailers, hotels and restaurants), institutional applications (e.g., hospitals, universities and schools) and transit facilities (e.g., commuter rail, rapid transit and Bus Rapid Transit (BRT)). The visually impaired may elect to utilize TWS products to detect hazardous drop-offs (platform edge/loading dock) and hazardous vehicular areas (curb ramps on street corners and intersections, uncurbed transition between pedestrian and vehicular areas such as at the front of retail establishments). In addition to the ADAAG, there are several additional documents that offer similar guidelines. These include the Americans with Disabilities Act/Architectural Barriers Act Accessibility Guidelines (ADA/ABA) and the Public Rights of Way Accessibility Guidelines (PROWAG). Most current designs attempt to adhere to all of these guidelines.

Visually impaired and fully sighted persons may rely on a combination of visual cues (color contrast), tactile cues (sweeping cane, sole of shoe, through wheelchair wheels, walker wheels), and audio cues (sound attenuation, which can be achieved by use of dissimilar materials such as composite TWS and concrete substrate) when electing to use TWS products as a means of edge and hazardous vehicular area detection.

TWS products define a series of spaced raised truncated domes. See, e.g., U.S. Pat. No. 7,001,103 for a discussion of TWS products. These products are typically installed in curb ramps, pedestrian ways and commercial, retail and institutional areas by setting into the fresh concrete a plastic, composite or metal TWS product that defines on its upper surface the series of spaced raised truncated domes required by the ADAAG. Although such Cast-In-Place (CIP) TWS products are easy to install into wet concrete (typically taking only a few minutes), replacement is difficult and time consuming, and replacement costs are high, because the underlying substrate must be at least partially destroyed in order to remove an installed product, and then reconstructed for the replacement product.

Some of these CIP TWS Units define a relatively thin upper surface layer supported underneath by spaced honeycomb-like lower walls that are set in fresh concrete. Air can be trapped between the lower walls, which creates areas underneath the CIP TWS Unit that are not supported by the underlying substrate. Because they are thin to begin with, and in spots not supported, these CIP TWS Units can fatigue and crack under moderate or heavy loading, such as can be caused by pallet jacks, fork lifts and vehicles, for example. Also, due to the plurality of intersecting lower walls that are embedded in concrete, in some cases these CIP TWS Units cannot be replaced without tearing up and then rebuilding the concrete structure in which they were set; this is a time consuming and expensive proposition.

Another issue with ADAAG-compliant TWS products is that the projecting domes can be broken or sheared off by snowplows or the like, requiring replacement. Some fiberglass-reinforced epoxy resin TWS products have a body that is reinforced by a woven fiberglass mat. However, the domes are constructed of pure resin without any fiberglass reinforcement for impact resistance. These TWS products thus have projecting domes that are inherently weaker than the body. The domes thus can be more easily cracked, broken or sheared off.

Some CIP TWS Units are set into fresh concrete with fasteners that pass through holes located in the domes. There are also CIP TWS Units in which the head of the fastener is shaped like a dome, in which case the fastener is located in place of one of the domes. In both such cases, if a dome is sheared or broken off, there is danger that the head of the fastener can be sheared or broken off, or at a minimum the fastener can be loosened. If this happens, the TWS product can come loose and present a safety or tripping hazard.

The prior state of the art for new construction includes composite shell CIP TWS Units. Composite shell CIP TWS Units are quickly and economically installed; however, if the installer is not diligent, CIP TWS Units are susceptible to air entrapment underneath the CIP TWS Unit and are thus susceptible to fatigue and cracking failure due to repetitive and/or heavy loading. Fatigue and cracking failure under repetitive heavy loading may also occur along the relatively thin perimeter flange structure. Once installed, CIP TWS Units are permanently embedded into the concrete substrate and it is thus difficult, invasive, time consuming, and costly to remove and replace CIP TWS Units when maintenance is required.

Another solution is a surface applied (SA) TWS panel that is applied to a finished substrate. A SA TWS panel is typically mechanically fastened (e.g., with a nylon sleeve anchor with a stainless steel pin) and adhered (e.g., using single component urethane adhesive) to the underlying substrate, and then caulked around the perimeter to compensate for substrate irregularities, minimize water intrusion, and provide a superior architectural finish. Installation takes 10-15 minutes for a 2'×4' SA TWS panel. Replacement of a SA TWS panel is easier than with a CIP TWS Unit, and is typically accomplished by removing the fasteners, heating the SA TWS panel to break the adhesive bond with the underlying substrate, prying the TWS panel off the substrate, removing existing adhesive, and installing a new SA TWS panel. The substrate basically remains intact. Perhaps 1 to 1½ hours labor is involved. Replacement cost is thus moderate. However, these SA TWS panels can more easily loosen or dislodge as compared to CIP TWS units. For example, a protruding edge or corner of the SA TWS panel can be caught by a snow plow and lifted. This can present a safety hazard. SA TWS panels may not be as acceptable as CIP TWS Units. SA TWS panels are an ideal solution for retrofit applications; CIP or replaceable (REP) TWS Units are an ideal, quick, and economical solution for new construction. The elevation of the body of a SA TWS panel is at least ⅛" above the surface of the underlying substrate; consequently, the body of the SA TWS panel is potentially vulnerable to damage from snow removal operations. The body of CIP or REP TWS Units are flush mounted relative to the adjacent substrate; consequently, the body of the TWS Unit is shielded or protected from damage due to snow removal operations. Flush mounted TWS Product installations may offer superior performance when compared to surface mounted TWS Product installations. As the fasteners in SA TWS Panels are located within the truncated dome, they may be vulnerable to damage from snow removal or similar shearing type action that the domes may be subjected to under everyday use.

Many of these TWS products have rectangular top surfaces, typically available in a variety of sizes, including 2 feet by 3 feet, 2 feet by 4 feet, 2 feet by 5 feet, 3 feet by 4 feet and 3 feet by 5 feet. In many applications, a number of TWS products are embedded in the ground to cover a larger area. For example, the edge of a train platform may have a large number of these TWS products to cover a platform that may be fifty of more feet in length.

As described above, to provide tactile warning, a plurality of elevated domes exists on the top surface of the TWS product. The ADDAG sets forth recommended dimensions for these domes. Specifically, the domes should be about 0.2 inches in height, 0.9 inches in diameter, and center-to-center spacing of between 1.6 and 2.4 inches.

FIG. 1 shows a representative rectangular TWS product, showing the size of the product, and the relative positions of the elevated domes on that product. In FIG. 1, the upper surface of a TWS product 10, measuring 2 feet by 4 feet is shown. A plurality of elevated domes 20 is shown on the upper surface. As seen in FIG. 1, each dome has a diameter of 0.9 inches, and is separated from its adjacent domes, in both the horizontal and vertical directions, by 2.4 inches (measured center-to-center).

Note that the elevated domes along the outer edges of the TWS product 10, such as domes 21-25 are 1.2 inches from the edge of the product 10. When two TWS products 10 are placed side by side, the dome 21 of one product is spaced 2.4 inches from dome 23 of the adjacent product, thereby maintaining the ADAAG recommended center-to-center spacing. Note also that corner dome 22 is 1.2 inches from the right edge and lower edge of the product 10. When placed in a configuration with other products, dome 22 will be 2.4 inches from dome 24 of the product below it, and 2.4 inches from dome 25 of the product to its right.

While maintaining proper center-to-center spacing across multiple TWS products is relatively straightforward for rectangular products, this requirement is much more difficult to meet where the TWS products are not rectangular. FIG. 2 shows a representative radial TWS product 30, which are commonly used at crosswalks at intersections. As seen in FIG. 2, the radial TWS product also has domes 40 on its upper surface.

The position of these domes 40 helps illustrate the challenges associated with non-rectangular TWS products. Note that it appears relatively straightforward to maintain center-to-center spacing in the radial direction 50. However the length of row 51 (nearest the inside radius) is less than that of row 52 (nearest the outside radius). Each row follows an arc, which represents a portion of the circumference of a circle. Thus, the length of each row is related to the radius of the circle on which the domes are placed. The rows nearest the inside radius follow an arc of a smaller circle than those of the outer rows. Assume that the inside radius is $R_i$ and the outside radius is $R_o$. If there is the same number of domes in each row, then the ratio of the center-to-center spacing of the inner row 51 to the outer row 52 can be approximately by $R_i/R_o$. If each row has the same number of domes, then necessarily, the upper row 52 of domes have a greater center-to-center spacing than those in lower row 51. If the outer radius is 10 feet and the inner radius is 8 feet (assuming a 2 foot wide TWS product), then the center-to-center spacing of the outermost row 52 would be approximately 10/8, or 1.25, of the center-to-center spacing of the innermost row 51. Thus, if the outermost row has a center-to-center spacing of 2.4 inches (i.e. the maximum allowed), the spacing for the innermost row would be approximately 1.92 inches. For different inner and outer radii, the center-to-center spacing for the various rows necessarily changes.

Although not shown in FIG. 2, in some embodiments, the domes 40 are not positioned in radial columns. For example, the domes 40 may be staggered in the radial direction. In addition, the domes 40 may not be arranged in arcs, such as rows 51,52. In some embodiments, the domes may be staggered in this direction.

Radial TWS products are used for various applications, such as pedestrian ramps at intersections. Unfortunately, not all of these applications have the same requirements. For example, in some applications, the outer radius may be required to be 20 feet, while other applications may require outer radii of 10 or 15 feet. To accommodate these various requirements, most TWS suppliers offer a variety of radial TWS products, each product having unique outer and inner radii.

The use of separate radial TWS products for each required radius has benefits and drawbacks. Since each radial product has a specific inner and outer radius, it is straightforward to design the dome pattern to meet the required center-to-center spacing. In addition, it is relatively straightforward to place the domes such that domes on adjacent products also satisfy the ADAAG requirements. However, the use of different radial TWS products also has drawbacks. For example, it is necessary for the supplier to design and manufacture a large number of different parts. This also requires suppliers or vendors to carry inventory of each of these various radial TWS products, thereby increasing inventory costs.

In addition, the existence of multiple radial TWS products complicates the installation process. The installers need to be certain to bring the correct part for the installation. Currently, an existing radial TWS product cannot be used to create a pattern for which it is not intended; there is a strong likelihood that one or more domes would be partially removed, or that the center-to-center spacing would be violated.

Therefore, it would be beneficial if the requirements for various dimensioned radial TWS products could be satisfied by a single radial TWS part, which met the center-to-center spacing requirements for the various configurations.

SUMMARY OF THE INVENTION

The shortcomings of the prior art are overcome by the present invention, which includes an apparatus and method for using a single radial TWS product for a variety of applications. Radial TWS products are used for pedestrian ramps at intersections and the like. Often, different applications require radial TWS products of varying dimensions. The present invention includes a radial TWS product, having domes on its upper surface, which are ADAAG compliant. Markings are placed on the bottom surface, which indicate the appropriate places where the TWS product can be cut to achieve patterns having a variety of effective radii. These markings are positioned such that, after being cut, the resulting radial TWS product continues to meet the ADAAG required center-to-center spacing between domes of adjacent cut TWS products.

DETAILED DESCRIPTION OF THE INVENTION

Figure 1:
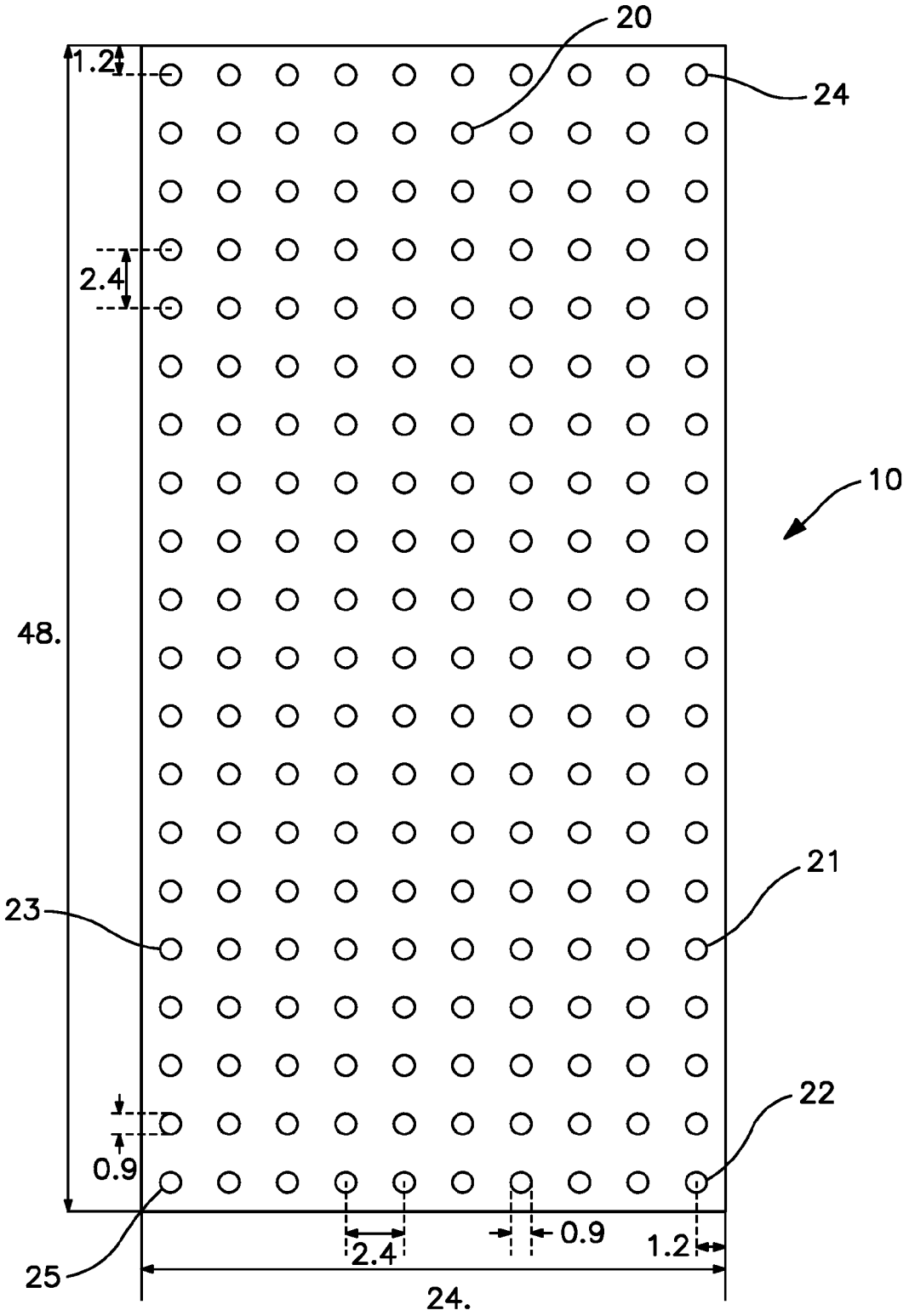
FIG. 1 (Prior Art)
FIG. 1 is a rectangular TWS product of the prior art.
Figure 2:
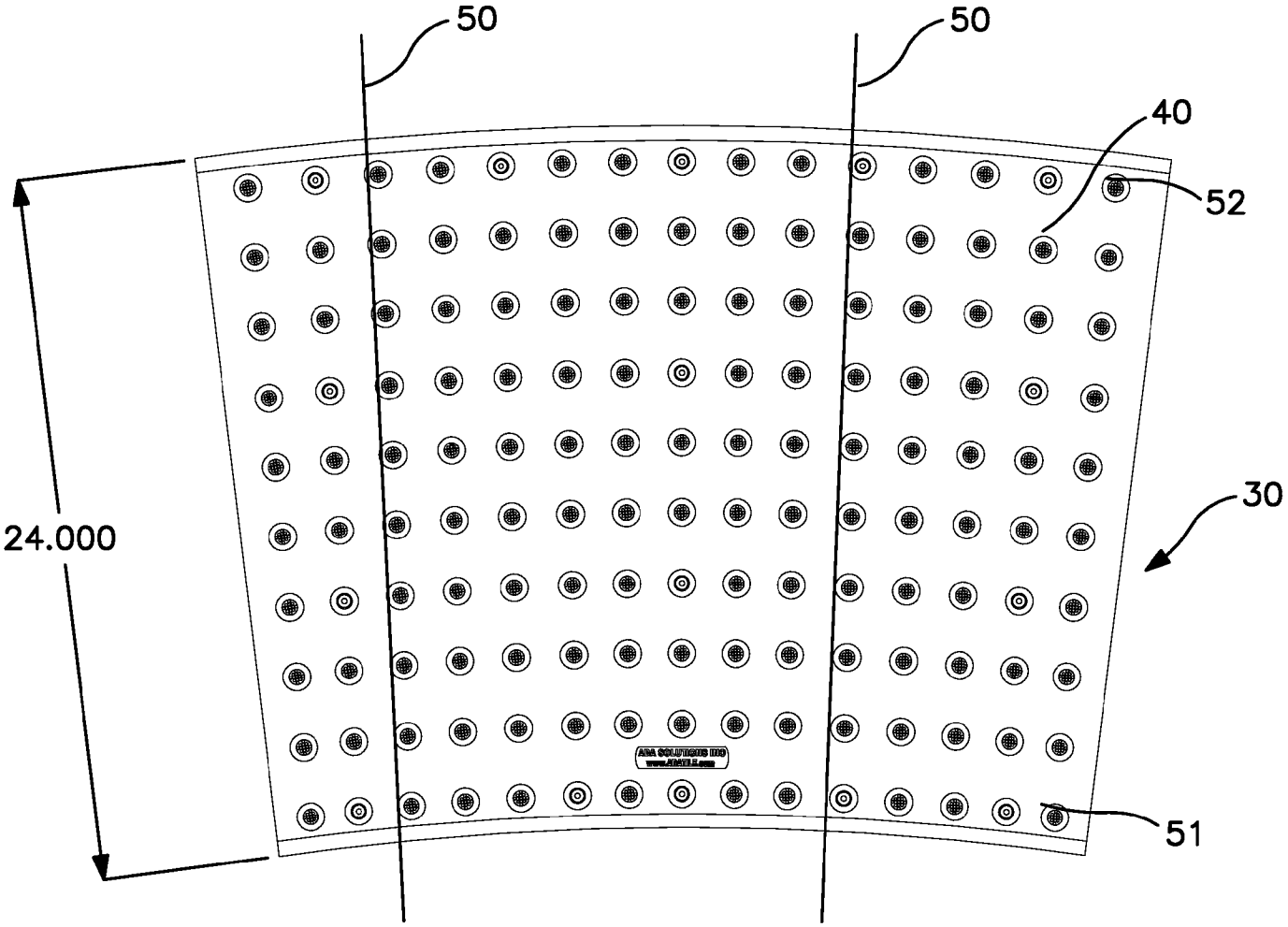
FIG. 2 is a radial TWS product.

As described above with reference to FIG. 2, a radial TWS product has a varying center-to-center spacing of its domes, where the domes nearest the outer edge are spaced further apart than those nearest the inner edge. In addition, there may be mandated center-to-center spacing, such as the ADAAG, that each TWS product must adhere to.

Previously, radial TWS products have been created with an outer edge, which is an arc of an outer circle having a first radius, $R_1$, and an inner edge, which is an arc of a concentric inner circle having a second radius, $R_2$, where the difference between $R_1$ and $R_2$ is equal to the width of the TWS product. Furthermore, the sides of these radial TWS products, connecting these edges are portions of radii of the outer circle, and are therefore perpendicular to the inner and outer edges at the point where they meet. A plurality of such radial TWS products can be used to create a TWS pattern, where the arc of the assembled pattern is roughly equal to $R_1$.

However, many applications that require TWS systems exist, requiring a plurality of arcs. To meet this requirement, a variety of radial TWS products, each designed for a specific outer radius, have been developed.

Advantageously, a single radial TWS product has been developed, which meets a specific center-to-center spacing requirement, such as those outlined in the ADAAG requirements, while being useful in a variety of applications requiring TWS patterns having arcs of various radii. While the center-to-center spacing is based on the ADAAG requirements, any predefined center-to-center spacing may be used. To achieve this, a TWS product is created having a plurality of markings. Each of these markings represents the location where the TWS product may be cut to create a derivative TWS product. The specific marking on which the cut is made determines the effective radius of the derivative TWS product, as explained below.

Figure 3A:
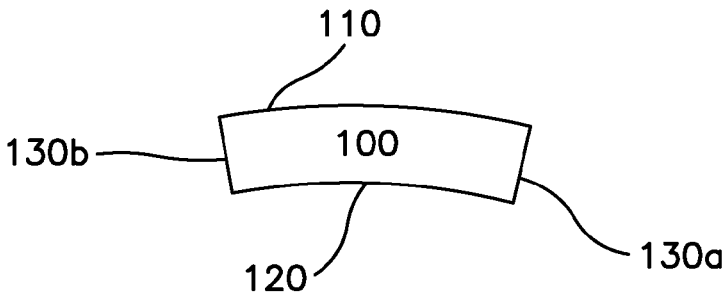
FIG. 3A-B show a first embodiment of a radial TWS product.

FIG. 3A shows a view of an embodiment of a TWS product 100 of the present invention as used in an application requiring a radius $R_3$. In this embodiment, the TWS product 100 has the characteristics of the prior art, in that it has an outer edge 110, an inner edge 120, and two sides 130*a,b*, which are perpendicular to the edges in the points where they meet. Although not shown in FIG. 3A for clarity, the TWS product 100 has elevated domes. As done in prior art TWS products, these elevated domes satisfy the ADAAG spacing requirements.

The radial TWS product may use any of the technologies discussed above. In particular, the radial TWS product may be a replaceable unit, or may be a surface applied unit.

In the case of a replaceable unit, the TWS product 100 is preferably unitary, solid and essentially homogeneous. In one embodiment, the body is made from a chopped fiber (e.g., fiberglass) reinforced resin composite material, and the unitary elevated domes are also made from the same composite material. In some embodiments, the composite material may include materials such as hard plastics, impact resistance plastics and composites, reinforced epoxy, glass reinforced polyester, a mixture of glass reinforced polyester with inorganic particulate matter or a mixture of polyurethane and inorganic particulate matter. Alternatively, the body and the projections may be made from a metal material, such as stainless steel or cast iron. The body may define a perimeter flange on its bottom surface that is thicker than the rest of the body. The product may in that case further comprise a plurality of spaced slots passing through the perimeter flange that allow air to escape from underneath the unit when it is installed in fresh concrete; the slots may communicate with the bottom of the flange and the area underneath the body inside of the flange. The perimeter flange may define an inner surface (and potentially also an outer surface) that is tapered such that the bottom of the flange is narrower than the top of the flange where it meets the rest of the body, to facilitate removal of the unit from set concrete. The perimeter flange may be about one inch wide. In one specific embodiment, the perimeter flange has a thickness of about ⅝ inches, and the rest of the body, with the exception of the locations of the projections, has a thickness of about ⅜ inches. In another embodiment, the perimeter flange is about ½ inches, and the rest of the body is about ¼ inches. In other embodiments, the perimeter flange may be thicker, such as ¾ inches or ⅞ inches. The replaceable TWS product also includes anchor members, which are described in more detail with respect to FIG. 7.

In some embodiments, the TWS product may also include ribs or ridges that protrude downwardly from the bottom surface of the product. These ridges supply additional strength and rigidity to the TWS product. In some embodiments, the thickness of the body of the TWS product can be reduced if a sufficient number of ribs or ridges are added to the bottom surface. These ribs may protrude less than one inch, such as between ¼ and ½ inches.

The present invention can also be used in conjunction with surface applied (SA) TWS tiles. In some embodiments, the SA TWS tile is constructed using a composite material, roughly 3/16" in thickness. As described above, a SA TWS panel is typically mechanically fastened (e.g., with a nylon sleeve anchor with a stainless steel pin) and adhered (e.g., using single component urethane adhesive or single component polyether adhesive) to the underlying substrate, and then caulked around the perimeter to compensate for substrate irregularities, minimize water intrusion, and provide a superior architectural finish. In some embodiments, sixteen fasteners are used, which secure the TWS product near its perimeter and also near the center of the TWS product. The fasteners preferably pass through 16 domes of the TWS product (shown in FIG. 6 as domes 224 with open centers). The top surface of the SA TWS product contains a plurality of unitary elevated domes. In some embodiments, a perimeter bevel of about ½" wide exists on the edges and sides of the TWS product. This perimeter bevel offers a gradual ramp from the substrate elevation to that of the TWS product to minimize potential tripping/safety hazards for the pedestrian. The perimeter bevel also provides a ramp so that snow removal equipment can be used while minimizing the risk of damage to the SA TWS part.

By cutting the radial TWS product along one of the markings, it is possible to affix a plurality of like derivative TWS products to a surface to create a domed pattern having one of a variety of radii.

Figure 3B:
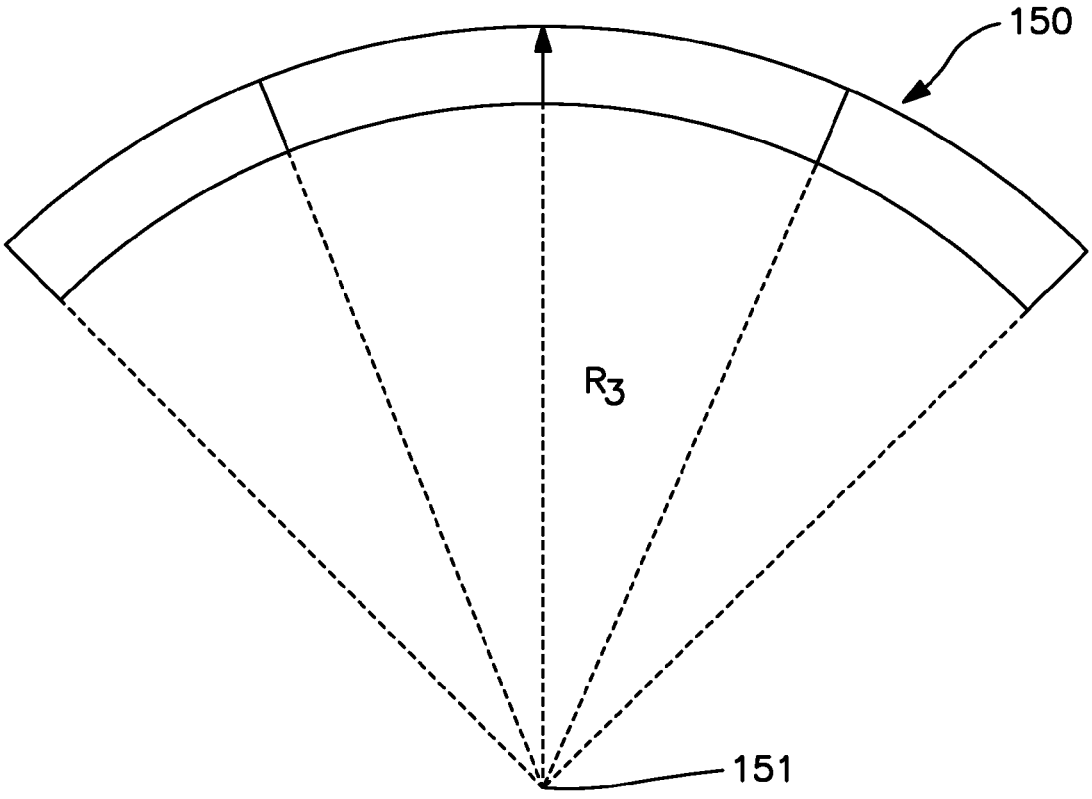

FIG. 3B shows a number of TWS products 100 assembled together to achieve a pattern 150 having an arc equal to $R_3$. Note that, since the radius of the arc of the outer edge 110 is the same as the radius of the arc of the pattern 150, the assembled TWS products 100 create a smooth arc along the outer edge of each TWS product 100. Furthermore, each of the sides 103*a,b* of the TWS product 100 is a radii of a circle having a center 151 and a radius $R_3$.

Figure 4A:
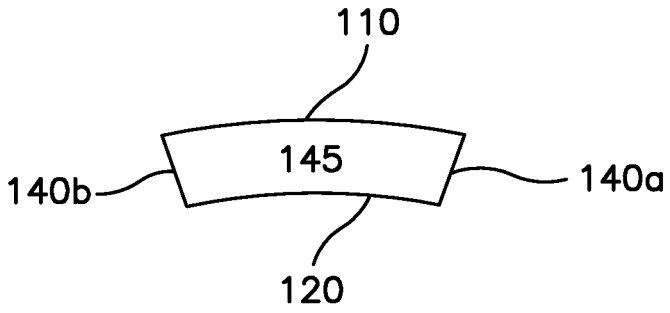
FIG. 4A-B show a second embodiment of a radial TWS product.

FIG. 4A shows a view of the TWS product 100 of the present invention as used in an application requiring a radius $R_4$, where the radius $R_4$ is less than the radius $R_3$ described above. In this embodiment, the TWS product is cut along a marking denoting radius $R_4$, thereby creating a derivative TWS product 145. Note that the radius of the arc of the outer edge 110 of the derivative TWS product 145 remains $R_3$. However, the sides 140*a,b* are no longer perpendicular to the outer edge 110 and inner edge 120. Thus, the derivative TWS product 145, when assembled with other like derivative TWS products, creates a pattern 160 having an arc having a radius less than that of the outer edge 110. A circle 161 of radius $R_4$ is shown superimposed on the TWS pattern 160. Note that while the edges of the derivative TWS products 145 are outside of the superimposed circle, the pattern 160 has an effective radius $R_4$. The term "effective radius" is used to signify that while the arc of each of the radial derivative TWS products 145 is $R_3$, the pattern 160 created by assembling multiple like derivative TWS products 145 creates a figure that approximates a circle, having a radius $R_4$. Furthermore, note that each side 140*a,b* may be a radius of circle 161.

Figure 4B:
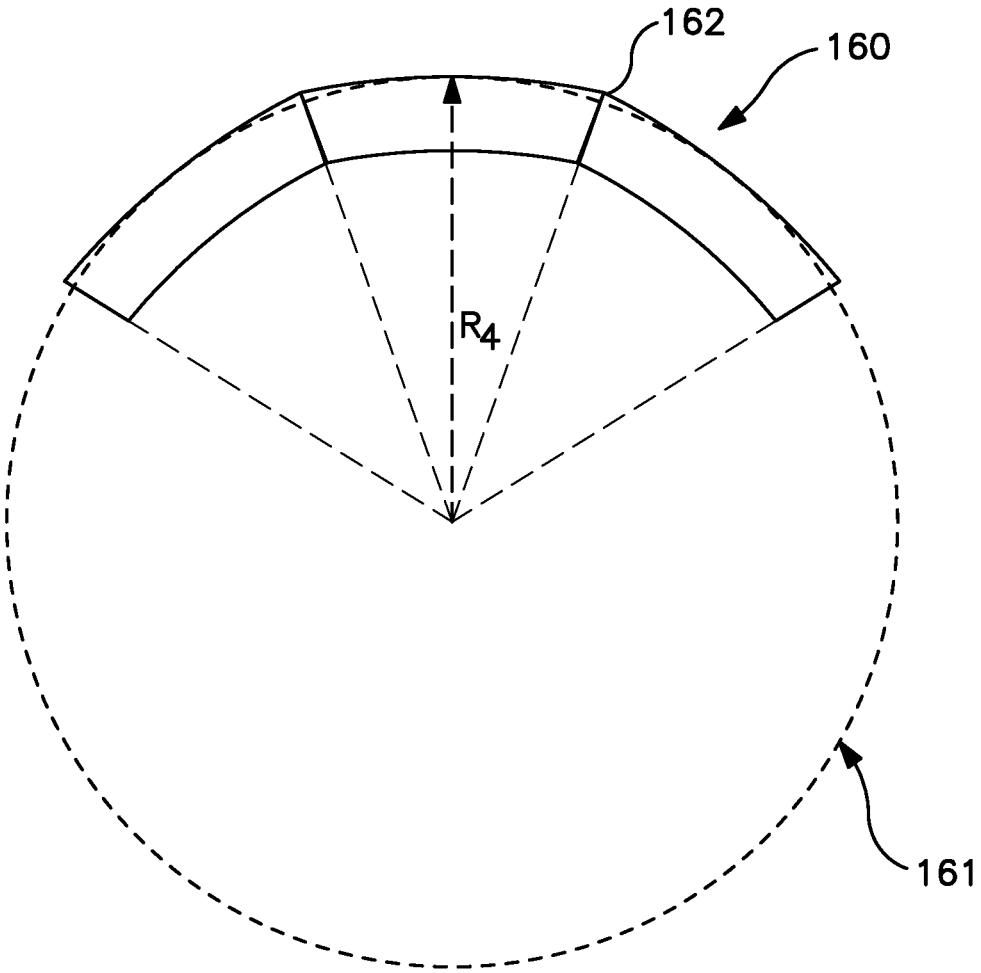

It is also shown in FIG. 4B that when the effective radius is less than the radius of the outer edge 110, the corners 162 of the derivative TWS products 145 are slightly outside the circle 161. In some embodiments, the installer may clip or cut off corners 162, such that the TWS pattern 160 more closely represents the circle 161. The amount to be cut off depends on the effective radius and the radius of the outer edge 110. In some embodiments, only ⅛ to ¼ inch needs to be removed. These corners 162 may be cut off using any suitable device. Even if these corners need to be clipped for aesthetic reasons, it is obvious that far less cutting is required in this case than if standard radial or rectangular tiles are used. In addition, the quality and ease of the installation is far better than if standard rectangular tiles are used. In other embodiments, the existence of corners 162 is acceptable, and the tiles 145 are not altered to remove corners 162.

Figure 5A:
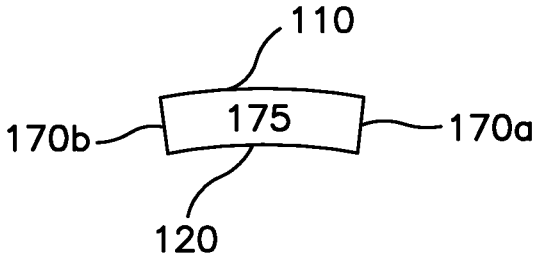
FIG. 5A-B show a third embodiment of a radial TWS product.
Figure 5B:
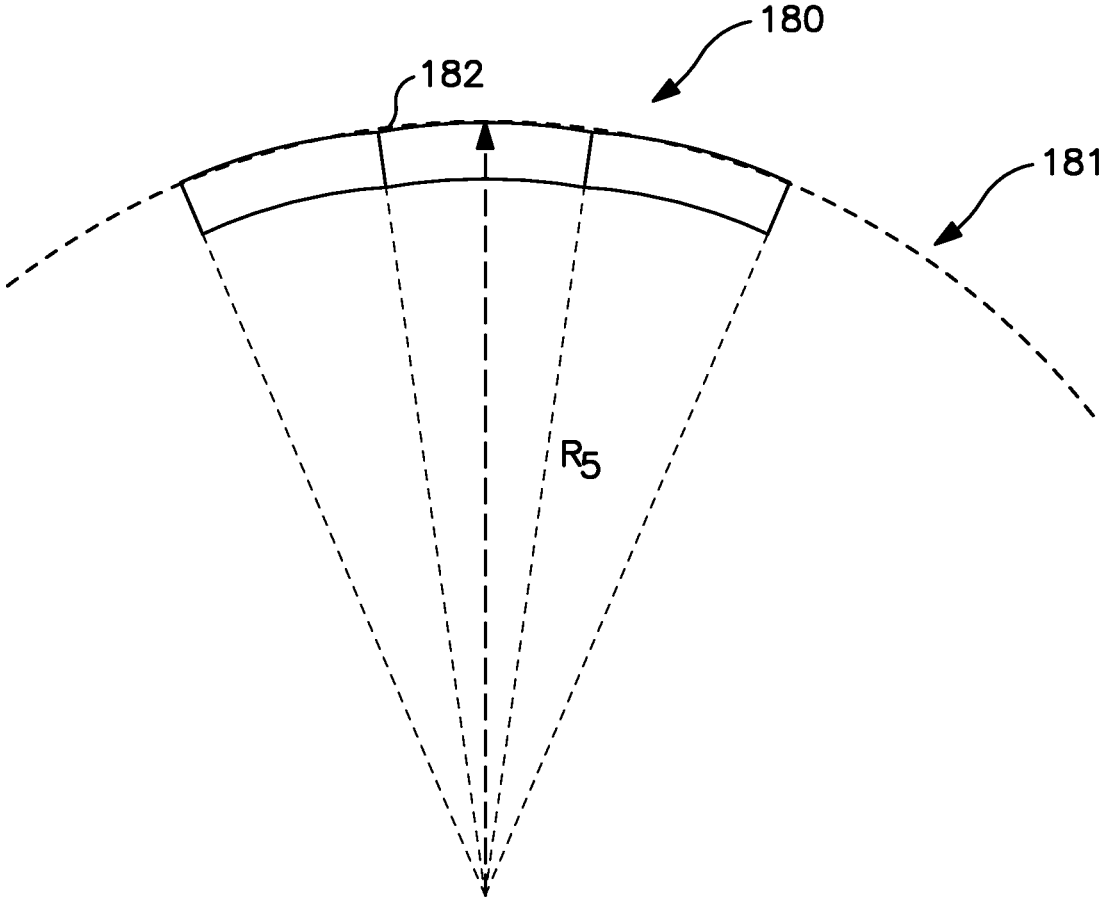

FIG. 5A shows a view of the TWS product 100 of the present invention as used in an application requiring a radius $R_5$, where the radius $R_5$ is greater than the radius $R_3$ described above. In this embodiment, the TWS product 100 is cut along a marking denoting radius $R_5$, thereby creating a derivative TWS product 175. Note that the radius of the arc of the outer edge 110 of the derivative TWS product 175 remains $R_3$. However, the sides 170*a,b* are no longer perpendicular to the outer edge 110 and inner edge 120. Thus, the derivative TWS product 175, when assembled with other like derivative TWS products 175, creates a pattern 180 having an arc with an effective radius greater than that of the outer edge 110. Arc 181, which is part of a circle having a radius $R_5$, is superimposed on pattern 180. In this scenario, since the effective radius is greater than the radius of outer edge 110, corners 182 of the derivative TWS products 182 are inside the arc 181.

Figure 6:
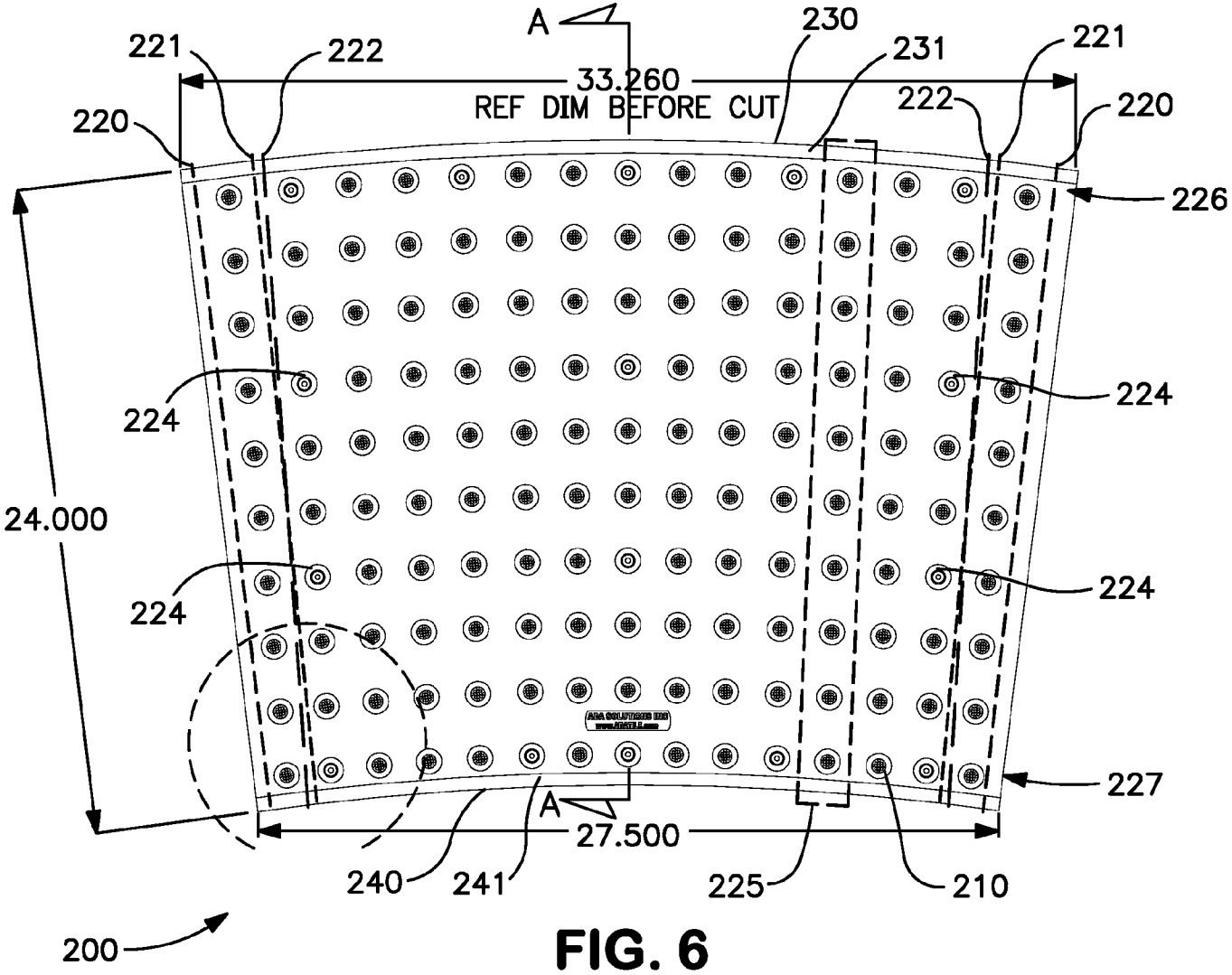
FIG. 6 shows a top view of the radial TWS product of the present invention.
Figure 7:
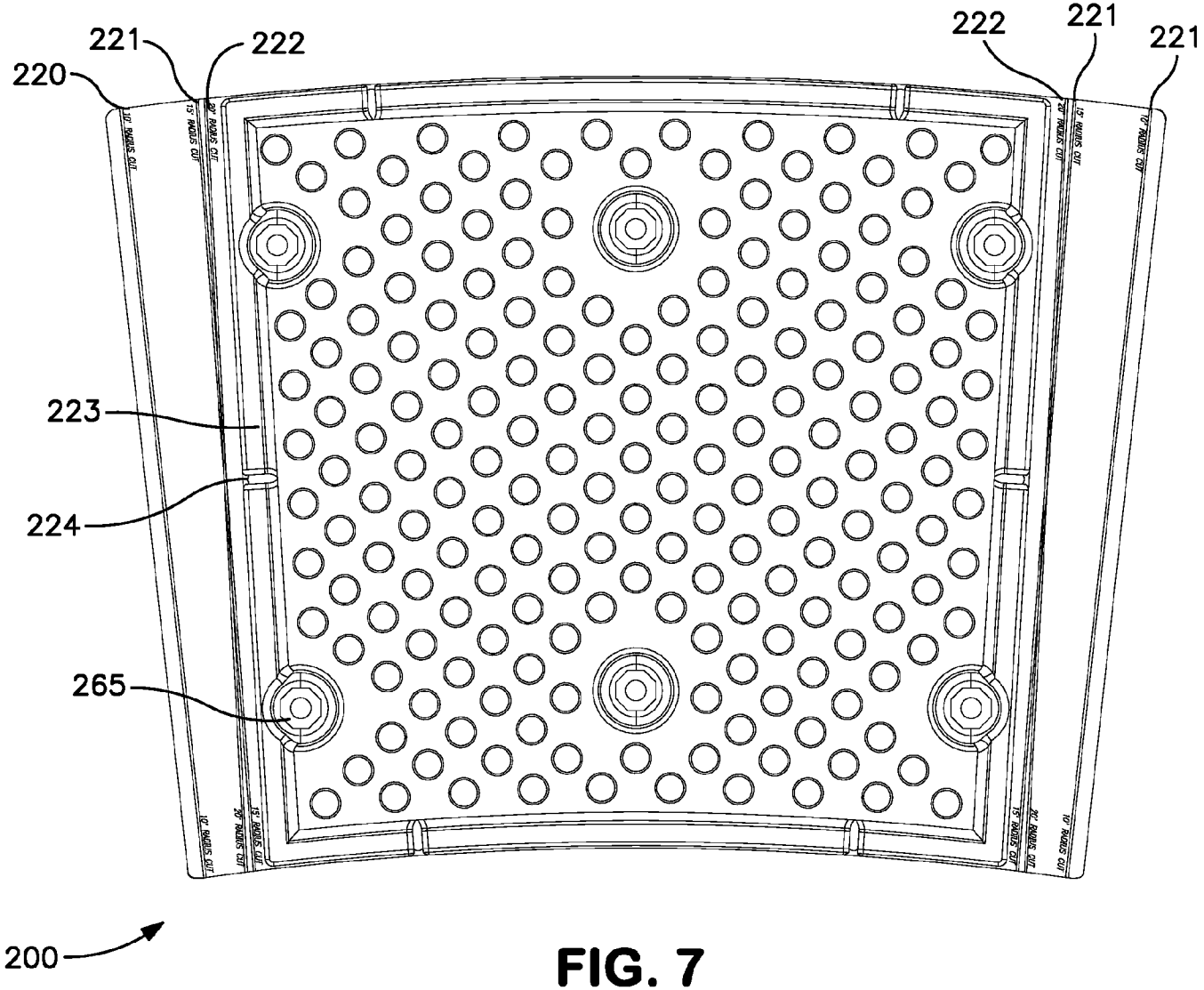
FIG. 7 shows a bottom view of the radial TWS product of the present invention.

FIG. 6 shows a top view of one embodiment of a TWS product 200, having a plurality of elevated domes 210, adhering to the ADAAG center-to-center spacing requirements. Superimposed on TWS product 200 are a plurality of lines 220, 221, 222, each of which marking the location where the TWS product 200 may be cut to achieve a particular effective radius. These markings preferably appear on the bottom surface of the TWS product 200 (as shown in FIG. 7). In this embodiment, the outer edge 230 of the TWS product 200 is an arc, which is part of a circle having a radius of 10 feet. The width of the TWS product 200 is 2 feet, therefore the radius of the inner edge 240 is 8 feet. In this embodiment, three sets of markings are shown. If the TWS product 200 is cut along lines 220, it can be used to create a derivative TWS product, which, when assembled with other like derivative TWS products, forms a pattern having an effective radius of 10 feet. If the TWS product 200 is cut along lines 221, it can be used to create a derivative TWS product, which, when assembled with other like derivative TWS products, forms a pattern having an effective radius of 15 feet. Finally, if the TWS product 200 is cut along lines 222, it can be used to create a derivative TWS product, which, when assembled with other like derivative TWS products, forms a pattern having an effective radius of 20 feet. Although three sets of markings are shown in FIG. 6-7, the invention is not limited to this embodiment. Indeed, more markings or fewer markings can also be applied. For example, a marking that is between the marking 222 and marking 221 would be used to create a derivative TWS product that can be used to form a pattern having an effective radius that closely approximates 17.5 feet. Markings can also be added to create a pattern having an effective radius of less than 10 feet if desired. Furthermore, markings can also be applied to the upper surface of the TWS product, if desired.

The embodiment of FIG. 6 includes 10 domes extending in the radial direction (i.e. radial columns 225). Each row (which extends along an arc) includes 15 domes, thereby creating a radial TWS product 200 having a total of 150 elevated domes. In some embodiments, there are smaller domes or raised areas between the domes. In other embodiments, the domes are not arranged in arcs, or may be staggered. The TWS product 200 is also about 33.26 inches at its widest point, and 27.5 inches at its narrowest point. In this embodiment, the center-to-center spacing in the outermost row 226, is greater than that of the innermost row 227. These reflect the measurements of the TWS product before any cuts have been made to create derivative TWS products. The measurements shown in FIG. 6 and the subsequent figures are intended for illustrative purposes. Other dimensions of the radial TWS product, the dimensions of the center-to-center spacing, and various locations for the markings can be modified and are within the scope of the invention.

Note that these dimensions vary for each derivative TWS product. In fact for derivative TWS products used for and 20 foot radii patterns, the product only has 130 domes, as one radial column of 10 domes is cut off along each side. It is important to note that there is no requirement regarding the elimination of columns of domes in creating a derivative TWS product. Note that for the derivative TWS product for use with 10 foot patterns, no domes are eliminated. In other embodiments, it may be desirable to cut off more domes, such as two or more radial columns from each side.

While cutting the product along the lines 220,221,222 creates various derivative TWS products, these lines are also in locations where the acceptable center-to-center spacing between adjacent derivative TWS products is maintained.

Figure 10:
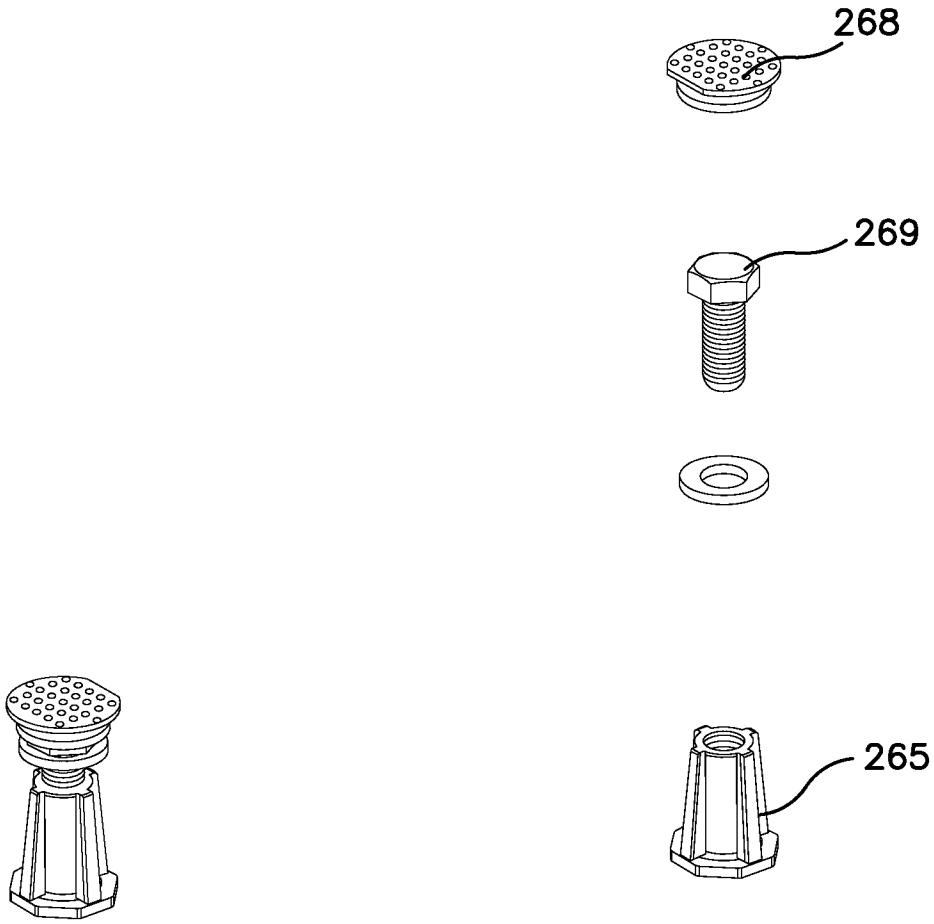
FIG. 10 shows a view of the cover, fastener and anchor used in one embodiment.

FIG. 7 shows a bottom view of one embodiment of the present invention used as a replaceable TWS product. This figure shows the marking 220,221,222 described above. In some embodiments, the TWS product 200 is formed with holes extending through the product, through which fasteners 269 (see FIG. 10) are passed. These fasteners 269 are affixed to anchor members 265. These through holes are spaced apart on the bottom surface of the TWS product 200. In some embodiments, the anchor members 265 are positioned such that for all derivative TWS products, the holes and anchor members 265 are all included. Note that in this embodiment, there are six holes and six anchor members, all of which are within the markings 220,221,222. These anchor members 265 allow the product to be replaced after installation. A detailed description can be found in U.S. Pat. No. 7,779,581, entitled "Replaceable Wet-Set Tactile Warning Surface Unit and Method of Installation and Replacement", which is incorporated by reference in its entirety.

The anchor members 265 preferably comprise metal concrete inserts. The fasteners (bolts) 269 are preferably metal hex head bolts. The lower surface of the body surrounding each of the holes extending therethrough may define a downwardly-protruding lower projection 267 (see FIG. 8). The downwardly-protruding lower projections 267 may define a tapered, generally truncated conical shape such that the bottom of the projection is narrower than the location at which the projection meets the rest of the body. The conical shape of the lower projections may define a taper angle of about 120 degrees. In other embodiments, there is no downwardly-protruding lower projection at the site of each hole. Threaded anchor members 265 are typically flared, heavy-duty zinc members, such as 1.5 inch long precast concrete inserts. In other embodiments, different lengths, such as 1-inch inserts, can be used when the setting bed is not as thick. It is also within the scope of the invention to use other materials, such as plastic, to form the inserts. Anchor members 265 have a generally tubular main body with internal threading to accept a threaded bolt, and flared ribs that end at an enlarged lower circular or hexagonal base having a diameter of about 1.25 inches. The flared shape and enlarged base help to firmly embed the anchor members in the concrete substrate as it sets. U.S. Pat. No. 7,779,581 discloses a TWS product for use with anchor members 265.

Figure 8:
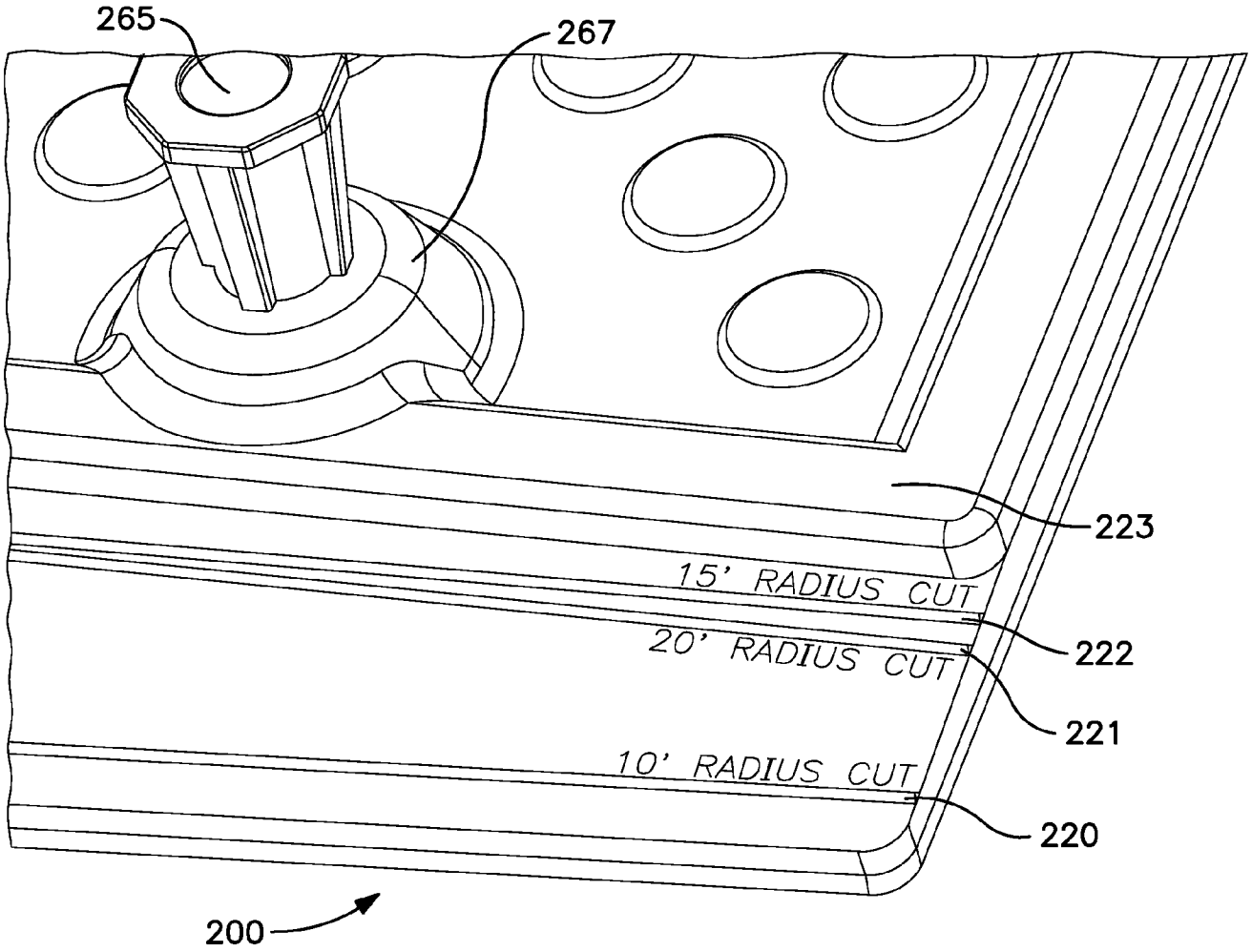
FIG. 8 shows an enlarged view of a portion of the bottom surface of the radial TWS product.

FIG. 8 also shows the positions of markings 220,221,222, relative to one another and to one of the anchor members 265. Note that the perimeter flange 223 is also preferably contained within all of the markings 220,221,222, such that the perimeter flange 223 remains integral with the TWS product 200, regardless of which markings are used for cutting the product 200. Furthermore, perimeter flange 223 may have a plurality of slots 224 (see FIG. 7) located around the edges to allow air to escape when the product is being installed.

Figure 9:
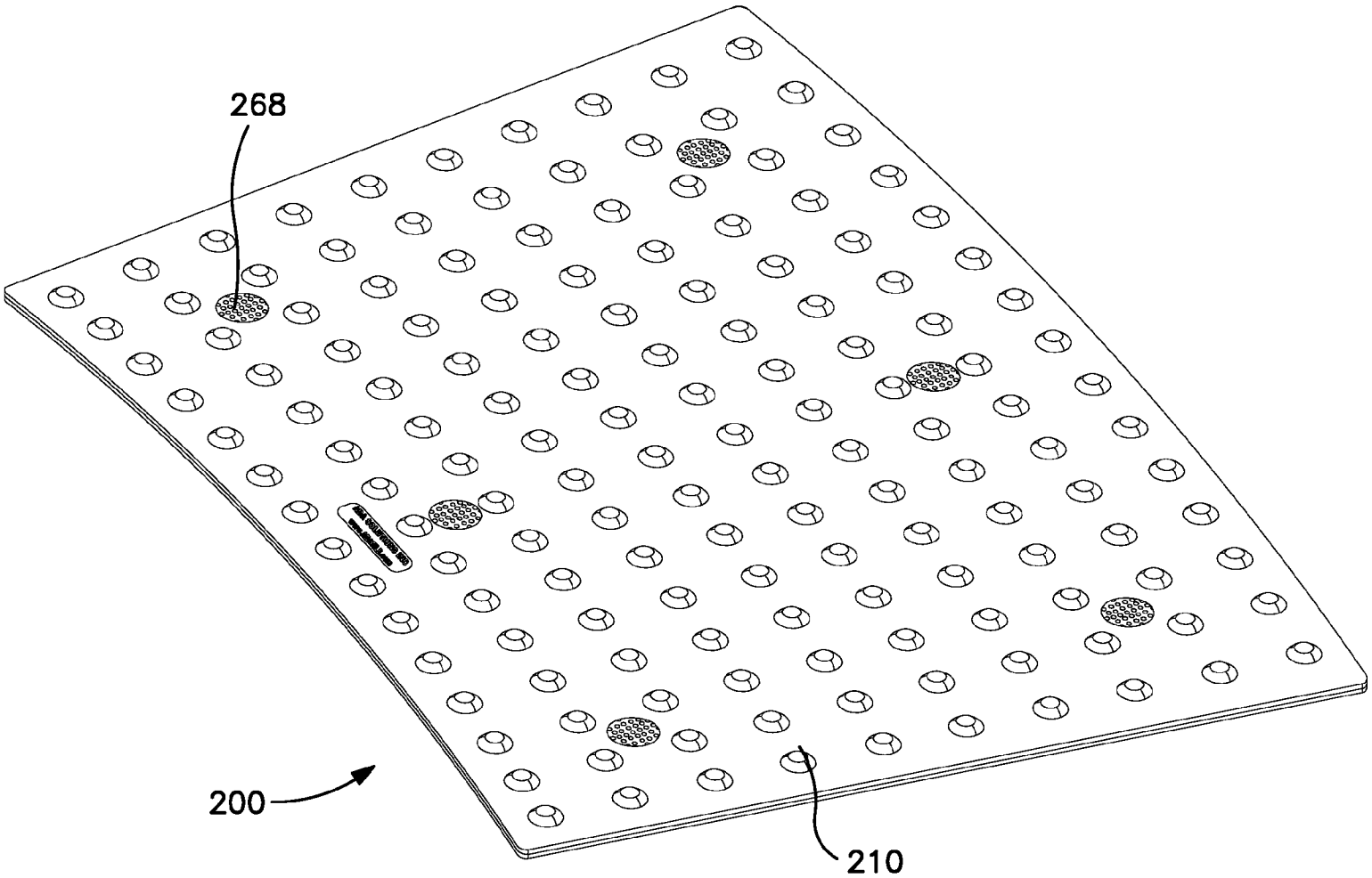
FIG. 9 shows a bottom view of the radial TWS product of the present invention.

FIG. 9 shows a top view of the radial TWS product 200, showing the elevated domes 210. Also shown is a plurality of covers 268, which are level with the upper surface of the TWS product 200. These covers 268 are used to cover the fasteners 269 described above. In operation, the fastener 269 (see FIG. 10) passes through the hole extending through the product 200, and is affixed to the anchor member 265. The TWS product 200 is then set in wet concrete, so that the anchor members 265 are pushed into the concrete. The covers 268 are snapped into place on the upper surface of the TWS product 200, thereby covering the fasteners 269. When the TWS product needs to be replaced, the covers 268 are removed, exposing the fasteners 269. The fasteners 269 are then unscrewed from the anchor members 265. An identically sized TWS product 200 is then used to replace the worn product. The new TWS product is placed on the concrete, where its holes are aligned with the anchor members 265. The fasteners 269 are then affixed to the anchor members 265, and the covers 268 are put back in place, covering the fasteners 269.

As mentioned above, the present invention can also be utilized for surface applied (SA) applications. For example, the embodiment shown in FIG. 6 is a surface applied TWS product. Perimeter bevels 231, 241 are used along the outer edge 230 and the inner edge 240. In this particular embodiment, perimeter bevels are not shown along the sides. However, in other embodiments, perimeter bevels are also on the sides. These side perimeter bevels may be intended to be removed when the TWS product is used to create a derivative product. This insures that when like derivative products are placed adjacent to one another, the TWS pattern is at a constant height. In certain embodiments, the side perimeter bevels are not removed at the ends of the pattern. For example, assume that 3 derivative TWS products are to be placed adjacent to one another to form a TWS pattern. The middle of the 3 TWS products is cut along both of its sides. The TWS product to the left of the middle TWS product is cut on its right side, which abuts the left side of the middle TWS product. Similarly, the TWS product to the right of the middle TWS product is cut on its left side, which abuts the right side of the middle TWS product. However, the left side of the left TWS product and the right side of the right TWS product need not be cut, as they do not abut any other TWS products. Thus, the perimeter bevel can be left intact. In this way, the entire TWS pattern is beveled along all of its outer edges and sides.

FIGS. 7-10 illustrate a radial TWS product intended to be used to create patterns with effective radii of between about 10 feet and 20 feet. In some applications, it may be necessary to have patterns with effective radii that are either larger or smaller than this range. In other words, in some embodiments, effective radii of less then 10 feet may be required. In other embodiments, patterns having an effective radius of 40 or more feet may be required. In some embodiments, a single radial TWS product can be used for all of these dimensions. In another embodiment, a small number of discrete radial TWS products may be created, where each can be used to create a pattern having a range of effective radii. For example, a first radial TWS product may be created to satisfy patterns having an effective radii of 10 feet of less. The radial product in FIGS. 7-10 may be used to create patterns having an effective radii of between 10 and 20 feet. A third radial product may be created to satisfy patterns of greater than 20 feet. In other embodiments, three radial products may be used to address patterns having small, intermediate and large radii, where the dimensions which define each category are determined based on the design of the particular TWS products.

As described in reference to FIG. 6, the previous embodiment assumes equal center-to-center spacing of domes in a given row, such as outer row 226 or inner row 227. In addition, the embodiment assumed equal center-to-center spacing in columns 225 in the radial direction for all domes. However, other embodiments are also possible. For example, a constant center-to-center spacing can be employed for all domes, regardless of which row they are in. In other embodiments, the center-to-center spacing is not constant in the radial direction. In other embodiments, the center-to-center spacing is not constant in a given row. For example, the center-to-center spacing of inner row 227 may be greater (or smaller) near the sides of the TWS product than in the middle of the product. The ADAAG suggests a range of center-to-center spacings.

Therefore, it is not necessary that the domes be placed in an orderly fashion of columns and rows. It is therefore possible to modify the position of each individual dome to meet the center-to-center spacing between adjacent TWS products for each pattern.

Thus, in some embodiments, a universal radius TWS product is created by first determining the desired inner and outer radius of the TWS product, its width and the effective radii that the TWS product is intended to support. Based on this information, the markings are then placed on the TWS product to denote the various lines on which the product can be cut. Having defined the dimensions of the TWS product and the locations of the various markings, the domes can then be placed. Consideration may first be given to the boundary conditions. For example, it may be desirable to first insure that center-to-center spacing between adjacent products is met for all of the supported effective radii. Once the domes along the outer sides of the product have been placed, the remaining domes can be placed. Since the ADAAG allows a wide range of allowable center-to-center spacings, this can be used to properly position each dome.

In another embodiment, a universal radius TWS can be created by first determining the desired inner and outer radius of the TWS product and its width. The domes can then be placed, using a regular pattern, using as uniform radial spacing and an equal number of domes per row. Then, based on the effective radii that are intended to be supported, possible locations for the markings can be determined. Preference is given to those locations which intersect with the fewest domes. Once optimal locations for the markings are determined, the locations of the domes are then adjusted to insure that the ADAAG requirements are met for the supported effective radii.

In other embodiments, a combination of these processes can be used, wherein the process may be iterative in order to determine an appropriate dome pattern.

Figure 11:
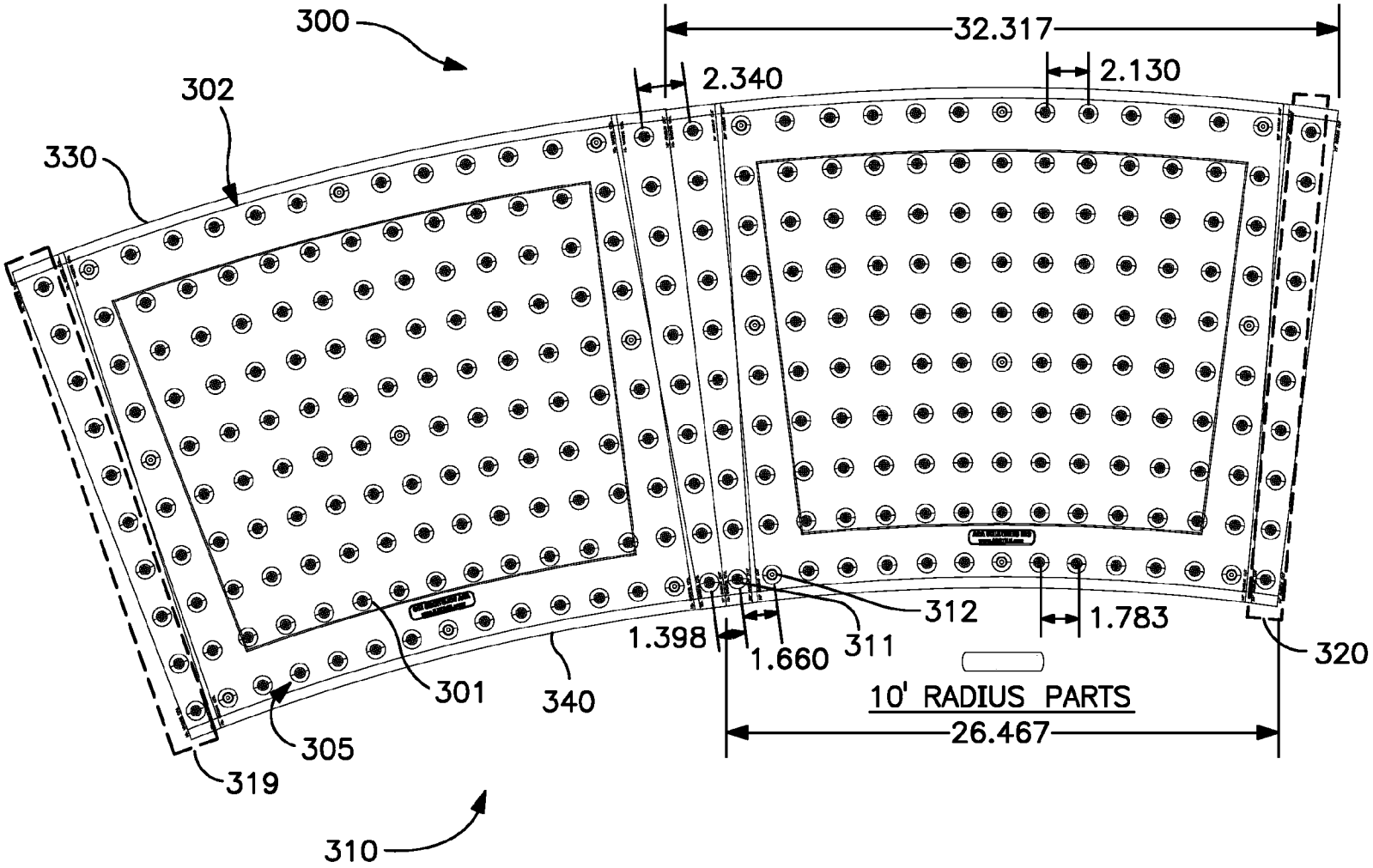
FIG. 11 shows a pattern having a first radius using an embodiment of a radial TWS product.
Figure 12:
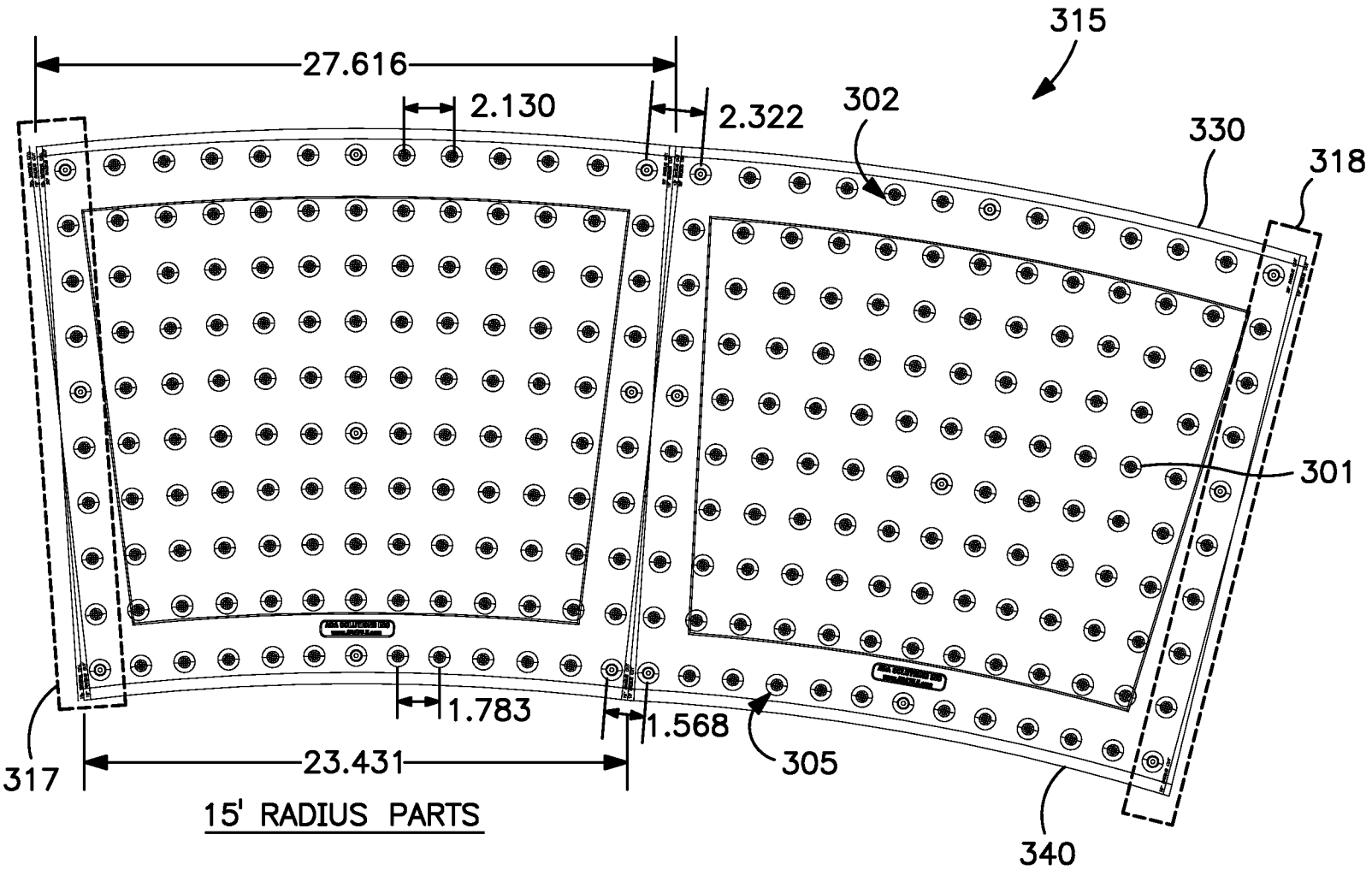
FIG. 12 shows a pattern having a second radius using an embodiment of a radial TWS product.
Figure 13:
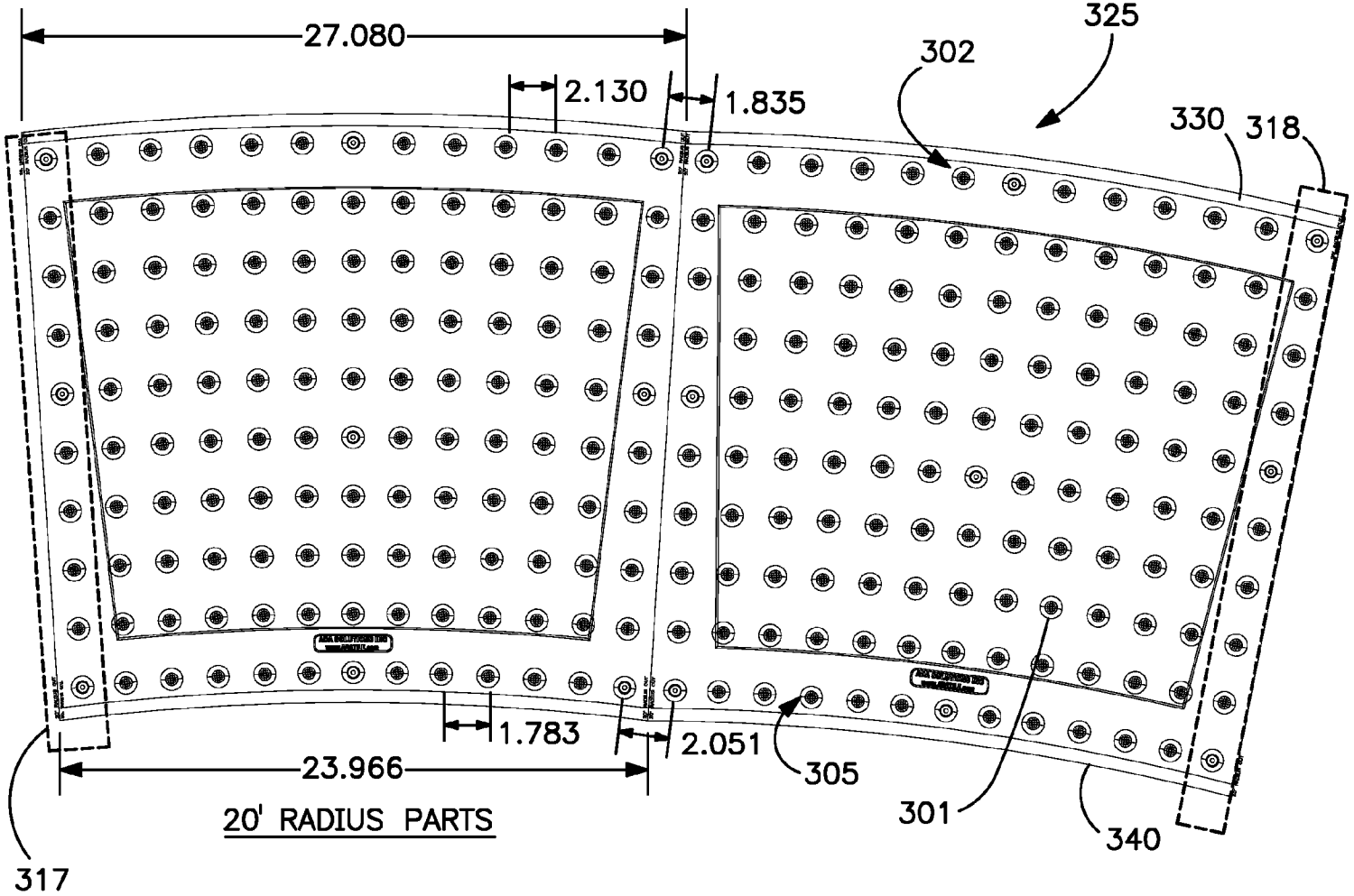
FIG. 13 shows a pattern having a second radius using an embodiment of a radial TWS product.

In one particular embodiment, shown in FIGS. 11-13, a radial TWS product 300 is used to create TWS patterns having effective radii of 10, 15 and 20 feet. The outer edge 330 of radial TWS product 300 is an arc, which is part of a circle having a radius of approximately 10 feet. The width of the TWS product 300 is 2 feet, therefore the radius of the inner edge 340 is approximately 8 feet. The center-to-center spacing of the domes 301 along the outermost row 302 of domes is nominally 2.13 inches, while the center-to-center spacing of the domes 301 along the innermost row 305 is nominally 1.783 inches. In this embodiment, the center-to-center spacing between the dome in the outermost columns 319, 320 and its adjacent neighbor is different than the rest of the spacing in that row. For example, the center-to-center spacing along the innermost row 305 between the outermost dome 311 and its neighbor 312 is 1.660 inches. Center-to-center spacing between other columns may also deviate slightly from the nominal values given above.

FIG. 11 illustrates a pattern having two derivative TWS products 310, made by cutting the radial TWS product 300 along the marking denoting 10 feet. In this embodiment, the center-to-center spacing between domes 311 on adjacent derivative TWS products 310 along the innermost row 305 is nominally 1.398 inches. The center-to-center spacing between domes on adjacent derivative TWS products 300 along the outermost row 302 is nominally 2.340 inches. When used to create a pattern having an effective radius of 10 feet, no domes are removed. Thus, the width of the derivative product 310 is nominally 32.317 inches at its widest point, and nominally 26.467 inches at its narrowest point. It is expected that there may be a joint, filled with caulk between adjacent TWS products. Thus, although the center-to-center spacing between domes on adjacent derivative TWS products 310 along the innermost row 305 may be nominally less than the ADAAG guidelines, the addition of caulk and the inaccuracy of cutting the TWS product will increase the spacing to an allowable separation.

FIG. 12 illustrates a pattern having two derivative TWS products 315, made by cutting the radial TWS product 300 along the marking denoting 15 feet. In this embodiment, the center-to-center spacing between domes on adjacent derivative TWS products 315 along the innermost row 305 is nominally 1.568 inches. The center-to-center spacing between domes on adjacent derivative TWS products 315 along the outermost row 302 is nominally 2.322 inches. Again, as described above, this measurement may not be exact, due to the presence of caulking and the inaccuracies of the cutting process. When used to create a pattern having an effective radius of 15 feet, the outermost column on each side of the TWS product 300 (columns 319, 320 on FIG. 11) is removed. Thus, the width of the derivative TWS product 315 is nominally 27.616 inches at its widest point, and nominally 23.431 inches at its narrowest point.

FIG. 13 illustrates a pattern having two derivative TWS products 325, made by cutting the radial TWS product 300 along the marking denoting 20 feet. In this embodiment, the center-to-center spacing between domes on adjacent derivative TWS products 325 along the innermost row 305 is nominally 2.051 inches. The center-to-center spacing between domes on adjacent derivative TWS products 325 along the outermost row 302 is nominally 1.835 inches. Again, as described above, this measurement may not be exact, due to the presence of caulking and the inaccuracies of the cutting process. When used to create a pattern having an effective radius of 20 feet, the outermost column on each side of the TWS product 300 (columns 319, 320 on FIG. 11) is removed. Thus, the width of the derivative TWS product 325 is nominally 27.080 inches at its widest point, and nominally 23.966 inches at its narrowest point.

In addition, the TWS products can be used to form more complex patterns. For example, an "S" curve can be created. One of more TWS products, comprising a first group of products, may be placed adjacent to one another to form a pattern as shown in FIGS. 11-13. Then, one or more TWS products, comprising a second group of products, may be placed adjacent to one another to form a second pattern as shown in FIGS. 11-13. The second group is placed adjacent to the previous placed first group, such that the inner edge of the first group of products is aligned with the outer edge of the second group, and the outer edge of the first group is aligned with the inner edge of the second group.

Although the embodiments disclosed herein described the protrusions on the upper surface as being ADAAG compliant elevated domes, the invention is not limited to these configurations. Other shapes and sizes for the protrusions are also possible. For example, the protrusions may be elevated domes, but may have a height and/or diameter which are different than that suggested in the ADAAG requirements. In addition, other shapes are also possible. For example, diamond shapes, hexagonal protrusions, or any other shape is also within the scope of the invention.

Figure 14:
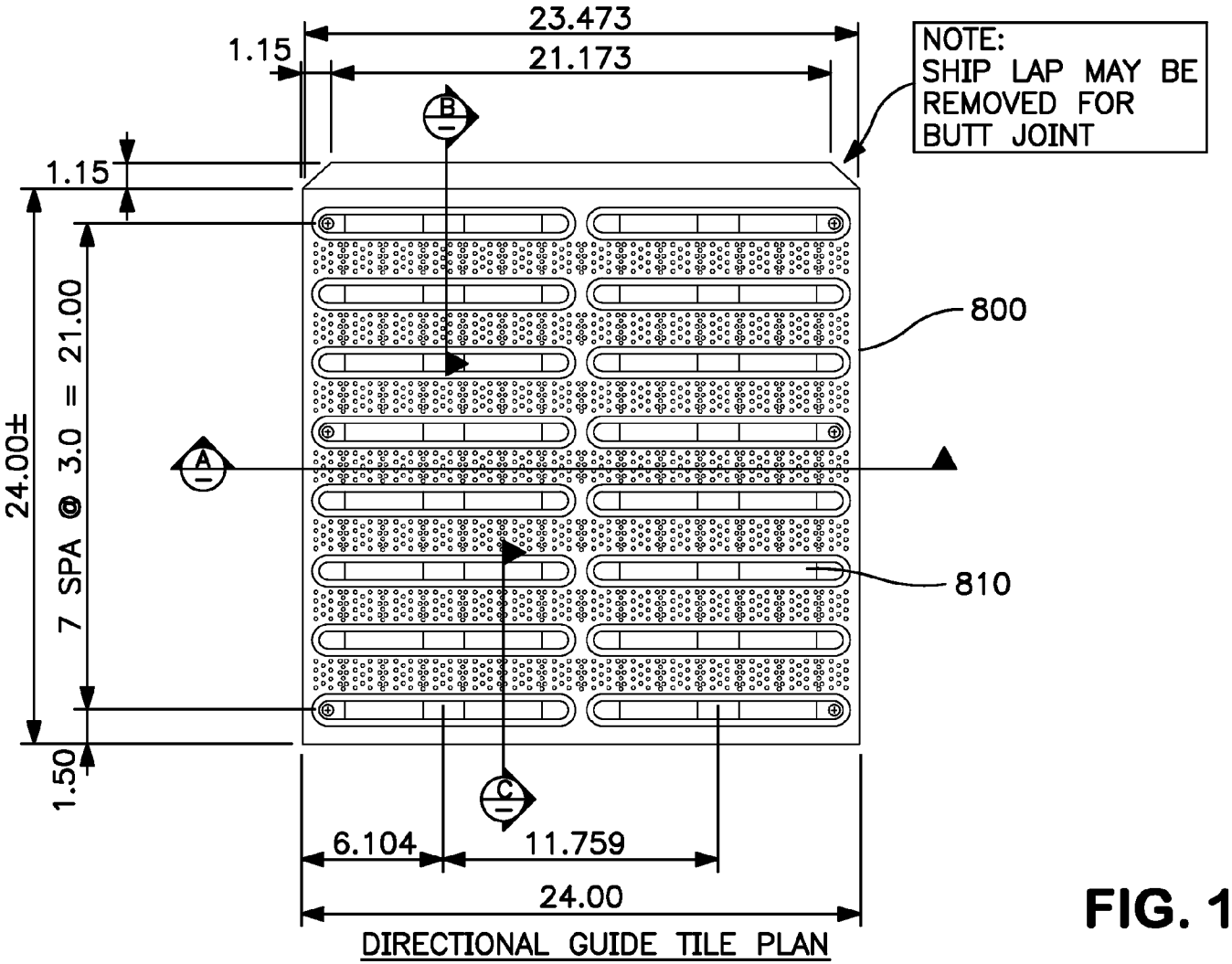
FIG. 14 shows a TWS product having a second type of upper protrusion.

Furthermore, in some embodiments, the protrusions may be in the shape of bars, where the length in one dimension is greater than the length in the orthogonal dimension. FIG. 14 shows a rectangular TWS product 800 having a plurality of protrusions 810, where the protrusions are oblong, or bar shaped. The protrusions 810 may be about ¾ and 1¼ inches wide and between 10 and 12 inches in length. For example, the TWS product shown in FIG. 14 may be used in some transit facilities to direct pedestrians from one point to another (e.g. a parking spot to a ticket machine or some other such convenience factor in the station). Another example is to apply 1'×4' strips immediately behind the TWS Product at designated and fixed locations. In some embodiments, the transit vehicle always stops at the same spot and the bar tile serves to orient and direct pedestrians directly into the vehicle's entry point. A similar protrusion can be applied to radial TWS products in accordance with the present invention.

Furthermore, although ADAAG specifications are referred to throughout the disclosure, the present invention may be used with any specification requiring predetermined center-to-center spacing.

The terms and expressions which have been employed herein are used as terms of description and not of limitation, and there is no intention in the use of such terms and expressions of excluding any equivalents of the features shown and described (or portions thereof). It is also recognized that various modifications are possible within the scope of the claims. Other modifications, variations, and alternatives are also possible. Accordingly, the foregoing description is by way of example only and is not intended as limiting.

What is claimed is:

1. A radial tactile warning surface (TWS) product, comprising:

an outer edge, formed as an arc of a first circle having a first radius, an inner edge formed as an arc of a second circle, having a second radius, two sides connecting said outer edge and said inner edge, an upper surface having a plurality of elevated domes, wherein the center-to-center spacing of each pair of adjacent domes is within a predetermined range; and a lower surface, wherein at least one of said upper or lower surface comprises a plurality of markings indicating where said radial TWS product may be cut, such that cutting said radial TWS product along one of said plurality of markings creates a derivative radial TWS product;

wherein each of said plurality of markings is used to create a different derivative radial TWS product, such that each of said derivative radial TWS products may be used with other like derivative radial TWS products to create a tactile warning surface having a unique effective radius.

2. The radial tactile warning surface (TWS) product of claim 1, wherein the center-to-center spacing of domes closest to a first side of one derivative radial TWS product and domes closest to an abutting second side of an adjacent like derivative radial TWS product are within said predetermined range.

3. The radial tactile warning surface (TWS) product of claim 1 further comprising a plurality of holes extending through said product, adapted to allow a fastener to pass through the product.

4. The radial tactile warning surface (TWS) product of claim 3, wherein said plurality of holes are all located within said markings so that all of said derivative TWS products comprise all of said plurality of holes.

5. The radial tactile warning surface (TWS) product of claim 1, wherein one or more of said elevated domes lay between one of said markings and one of said sides, such that they are removed to create one of said derivative TWS products.

6. The radial tactile warning surface (TWS) product of claim 1, further comprising a perimeter flange, having a thickness greater than the rest of the body of said TWS product.

7. The radial tactile warning surface (TWS) product of claim 6, wherein said perimeter flange is located within said markings so that all of said derivative TWS products comprise said perimeter flange.

8. A radial tactile warning surface (TWS) product, comprising:

an outer edge, formed as an arc of a first circle having a first radius, an inner edge formed as an arc of a second circle, concentric to said first circle, having a second radius, and two sides connecting said outer edge and said inner edge, whereby said sides are not radii of said first circle.

9. The radial tactile warning surface (TWS) product of claim 8, further comprising a plurality of holes extending through said product, adapted to allow a fastener to pass through the product.

10. The radial tactile warning surface (TWS) product of claim 8, further comprising a plurality of elevated domes on an upper surface of said product, such that the center-to-center spacing of each pair of adjacent domes is within a predetermined range.

11. The radial tactile warning surface (TWS) product of claim 8, further comprising a perimeter flange, having a thickness greater than the rest of the body.

12. A radial tactile warning surface (TWS) pattern, comprising:

a plurality of radial TWS products, each comprising:

an outer edge, formed as an arc of a first circle having a first radius, an inner edge formed as an arc of a second circle, concentric to said first circle, having a second radius, and two sides connecting said outer edge and said inner edge, whereby said sides are not radii of said first circle;

such that when said plurality of radial TWS products are arranged such that a first side of one radial TWS product is placed against an abutting second side of an adjacent radial TWS product, said TWS pattern is created wherein the effective radius of said pattern is different than said first radius.

13. The radial tactile warning surface (TWS) pattern of claim 12, further comprising a plurality of elevated domes on an upper surface of each of said plurality of products, such that the center-to-center spacing of each pair of adjacent domes is within a predetermined range.

14. The radial tactile warning surface (TWS) pattern of claim 12, wherein the center-to-center spacing of domes closest to said first side and domes closest to said second side are within said predetermined range.

15. The radial tactile warning surface (TWS) pattern of claim 12, wherein each of said plurality of radial TWS products comprises a perimeter flange, thicker than the rest of the body.

16. The radial tactile warning surface (TWS) pattern of claim 12, wherein each of said plurality of radial TWS products may be cut at a specific location so as, when arranged side by side, to create a pattern having a predefined effective radii.

17. The radial tactile warning surface (TWS) pattern of claim 12, wherein each of said plurality of radial TWS products comprising a plurality of markings, such that if all of said plurality of TWS products are cut along a same one of said plurality of markings, a pattern having a predefined effective radii is created when said plurality of TWS products are arranged side by side.

18. The radial tactile warning surface (TWS) pattern of claim 17, wherein each of said plurality of radial TWS products comprises a perimeter flange, thicker than the rest of the body.

19. The radial tactile warning surface (TWS) pattern of claim 18, wherein said perimeter flange is located within said markings so that all of said TWS products comprise perimeter flanges.

20. The radial tactile warning surface (TWS) pattern of claim 17, wherein each of said plurality of radial TWS products comprises a plurality of holes extending through said products, adapted to allow a fastener to pass through the products.

21. The radial tactile warning surface (TWS) pattern of claim 20, wherein said plurality of holes are all located within said markings so that all of said TWS products comprise all of said plurality of holes.

22. A radial tactile warning surface (TWS) product comprising:

an outer edge, formed as an arc of a first circle having a first radius, an inner edge formed as an arc of a second circle, having a second radius, two sides connecting said outer edge and said inner edge, a lower surface, having a perimeter flange that is thicker than the rest of the body of said product, wherein at least one of said upper or lower surface comprises a plurality of markings indicating where said radial TWS product may be cut, such that cutting said radial TWS product along one of said plurality of markings creates a derivative radial TWS product;

wherein said perimeter flange is located within said markings so as to be included in said derivative radial TWS product.

* * * * *